US005119737A

United States Patent [19]

Thorsen

[11] Patent Number: 5,119,737

[45] Date of Patent: Jun. 9, 1992

[54] APPARATUS AND METHOD FOR DRIVING A LARGE TRAVELING CRANE

[75] Inventor: George E. Thorsen, Wauwatosa, Wis.

[73] Assignee: Harnischfeger Corporation, Brookfield, Wis.

[21] Appl. No.: 607,946

[22] Filed: Nov. 1, 1990

[51] Int. Cl.[5] ..... B61D 15/00

[52] U.S. Cl. ..... 105/163.2

[58] Field of Search ..... 105/163.2, 163.1, 73, 105/76, 34.1, 34.2; 104/245, 247, 244

[56] References Cited

U.S. PATENT DOCUMENTS 2,935,032 5/1960 Tingokog ..... 105/163.2

3,703,016 11/1972 Schramm et al. ..... 105/163.2

FOREIGN PATENT DOCUMENTS 0334768 1/1959 Switzerland ..... 105/163.2

0623813 9/1978 U.S.S.R. ..... 105/163.2

*Primary Examiner*—Robert J. Oberleitner

*Assistant Examiner*—Mark T. Le

*Attorney, Agent, or Firm*—Richard C. Ruppin

[57] ABSTRACT

A drive for a traveling bridge crane including a bridge having a width spanning two parallel spaced apart rails and opposite ends located at one of the rails. A first pair of wheels comprising first and second wheels are respectively mounted at the opposite ends of the bridge and each of the first and second wheels engage a different one of the rails. A second pair of wheels comprising third and fourth wheels are also mounted at the opposite ends of the bridge and each engage a different one of the rails. The crane travels along the rails on the first and second pair of wheels in a position generally parallel to the rails. The crane is subject to unbalanced wheel rotating forces causing the crane to frequently attempt to skew. First and second drive mechanisms are respectively connected to the first and second wheels of the first pair of wheels for rotating the first and second wheels independently of each other. A third drive mechanism is connected to both of the third and fourth wheels. The third drive mechanism applies the unbalanced wheel rotating forces on the crane bridge equally to the third and fourth wheels to minimize skew movement of the third and fourth wheels and the independently driven first and second wheels. Minimizing of skew by the third drive mechanism maintains traction at each of the first, second, third and fourth wheels.

13 Claims, 4 Drawing Sheets

APPARATUS AND METHOD FOR DRIVING A LARGE TRAVELING CRANE

FIELD OF THE INVENTION

This invention relates to traveling bridge cranes which operate on spaced apart rails and, in particular, to the driving of large overhead traveling cranes on the rails.

BACKGROUND OF THE INVENTION

Overhead bridge cranes which travel on their wheels along spaced apart, generally parallel rails are subject to a variety of uneven forces which adversely affect the traction and efficient running of the cranes. Such forces typically cause skewing of the crane on the rails and high stress on the rails and the components of the cranes. Bridge crane drives are generally of two types. Either a cross shaft drive is used in which the opposite drive wheels engaging each of the parallel rails are mechanically connected together, so that under all crane traveling conditions the two wheels operate at the same rotational speed. The second type of drive is an independent drive at each opposite wheel of a pair of drive wheels which operate at the same rotational speed while the crane is operating in a desired, straight-line manner parallel to the rails. However, if the crane is subject to uneven loads or forces, including forces which may cause skewing, the rotational speed at either one of the independently driven wheels may decrease or increase to cause skew and exacerbate, or prevent recovery from, a skewed position of the crane.

Where two pairs of crane wheels are driven, as is common on larger bridge cranes, two cross shaft type drives may be used. However, in a double cross shaft drive, if a wheel of one pair of cross shaft connected wheels is subjected to forces which cause it to attempt to change speed, the difference in energy between the two cross shaft connected wheels is stored in the mechanical system of the two connected wheels, such as in shaft and gear members, bearings, and support and bolt members of the drive system. The storage of energy is more of a problem in a double cross shaft drive system, as compared to a single cross shaft drive system, because the former will not as readily change speed or position as the latter to avoid storing of energy in the drive system. The energy stored as described above in a double cross shaft drive system is subsequently released intermittently upon any momentary light load occurrence or traction loss such as rolling over a bump, hitting a joint, or joggling of the wheels as a result of a load change. This intermittent energy release causes further uneven running of the crane to result in its again storing energy and the perpetuation of a highly undesirable situation.

The other type of common drive system for large cranes where more than two wheels are driven is the driving of each wheel of each of several pairs of wheels with a separate, independent drive for that wheel. Independent drive systems have the well-known problem, when one of the independently driven wheels of a crane is subjected to unbalanced forces relative to other driven wheels such as unbalanced inertia forces of the swinging load carried by the crane trolley, to slow or increase the speed of the crane and cause it to quickly go into skew. Cranes driven with independent drives at each wheel require constant correction of a skewed condition of the crane, and are continuously subjected to undesirable, unbalanced stressing conditions.

SUMMARY OF THE INVENTION

It is a general object of the invention to provide a method and apparatus for driving large traveling bridge cranes on their rails at a high level of traction and with minimal skew problems.

The invention is accomplished by providing, in a traveling bridge crane, a bridge having a width spanning two parallel spaced apart rails and opposite ends each located at one of the rails. A first pair of wheels comprising first and second wheels are respectively mounted at the opposite ends of the bridge and each of the first and second wheels engage a different one of the rails. A second pair of wheels comprising third and fourth wheels are also mounted at the opposite ends of the bridge and each engage a different one of the rails. The crane travels along the rails on the first and second pair of wheels in a position generally parallel to the rails. The crane is subject to unbalanced wheel rotating forces along the width of the bridge and to other forces along the width of the bridge and to other forces causing the crane to frequently attempt to skew. First and second drive means are respectively connected tot eh first and second wheels of the first pair of wheels for rotating the first and second wheels independently of each other. A third drive means is connected to both of the third and fourth wheels. The third drive means applies the unbalanced wheel rotating forces on the crane bridge equally to the third and fourth wheels and the independently driven first and second wheels. A further result of the minimizing of skew by the third drive means is that traction at each of the first, second, third and fourth wheels is effectively maintained.

The third drive means may include means interconnecting the third and fourth wheels for steering the third and fourth wheels to correct skew of the crane. The third and fourth wheels are capable of steering the crane by the operation of their inner radially extending flanges. The inner wheel flanges face and are spaced apart from a rail with which the wheel from which they extend is engaged. The spacing distance of the inner flanges from an inner side surface of a rail is less than the spacing distance of the outer flanges on each of the wheels which face an outer side surface of the rails. The result of the smaller spacing distance of the inner flanges of the third and fourth wheels compared to the spacing distance of the outer flanges of the third and fourth wheels is that, when skewing of the third and fourth wheels takes places, the inner flange of the lagging wheel of the skewed one of the third and fourth wheels engages and rolls toward the rail and onto the rail which it engages, thereby raising the wheel on the rail, so that the larger diameter of the inner flange of the lagging wheel causes the lagging wheel to travel at a faster linear speed than the linear speed of the leading wheel of the pair of wheels to correct the skew.

The first and second wheels also have inner flanges extending from the wheels and facing inner side surfaces of the rails, and outer flanges extending from the wheels and facing outer side surfaces of the rails. The spacing distance of the inner flange of each first and second wheel from a rial side is less than the spacing distance from a rail side of the outer flange of each first and second wheel. This relative spacing distance of the flanges of the independently driven first and second wheels guides the crane along the rail and results in minimum skewing of the first and second wheels. If skewing does occur, it is relatively easily corrected since the skew angle will be quite small.

BRIEF DESCRIPTION OF THE DRAWINGS

Further objects and advantages of the invention will appear when taken in conjunction with the accompanying drawings, in which.

DETAILED DESCRIPTION OF THE INVENTION

Figure 1:
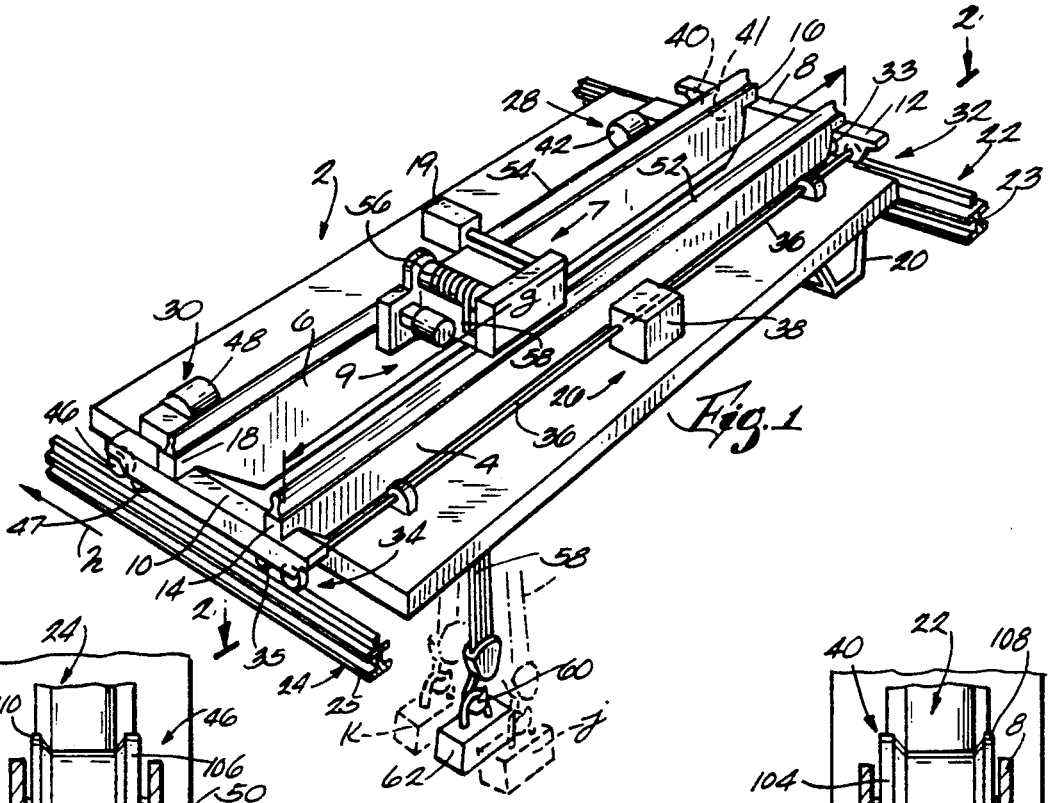
FIG. 1 is a perspective view of a traveling crane incorporating the apparatus of the invention.
Figure 2:
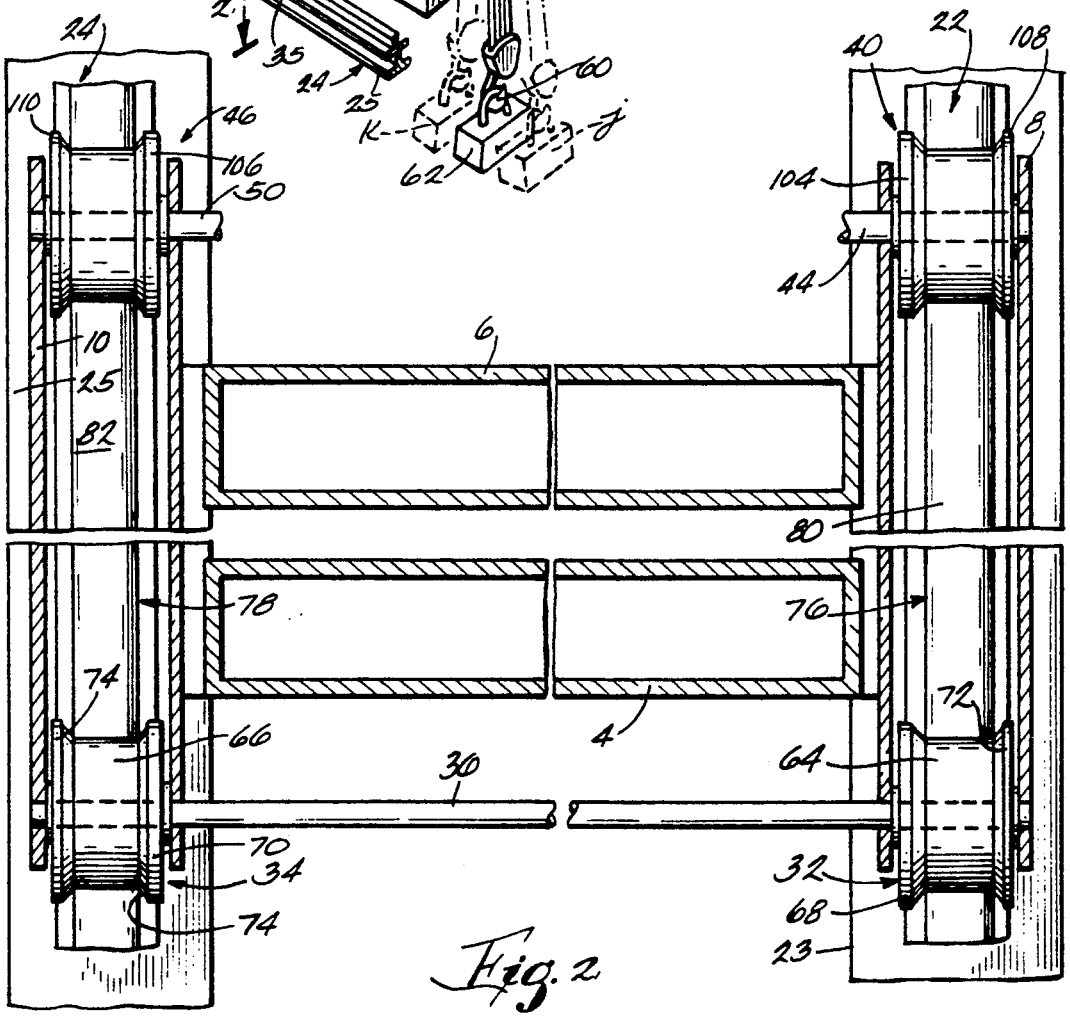
FIG. 2 is a plan view in cross section, taken along lines 2—2 of FIG. 1, partially broken away and with some parts removed for illustration purposes.
Figure 3:
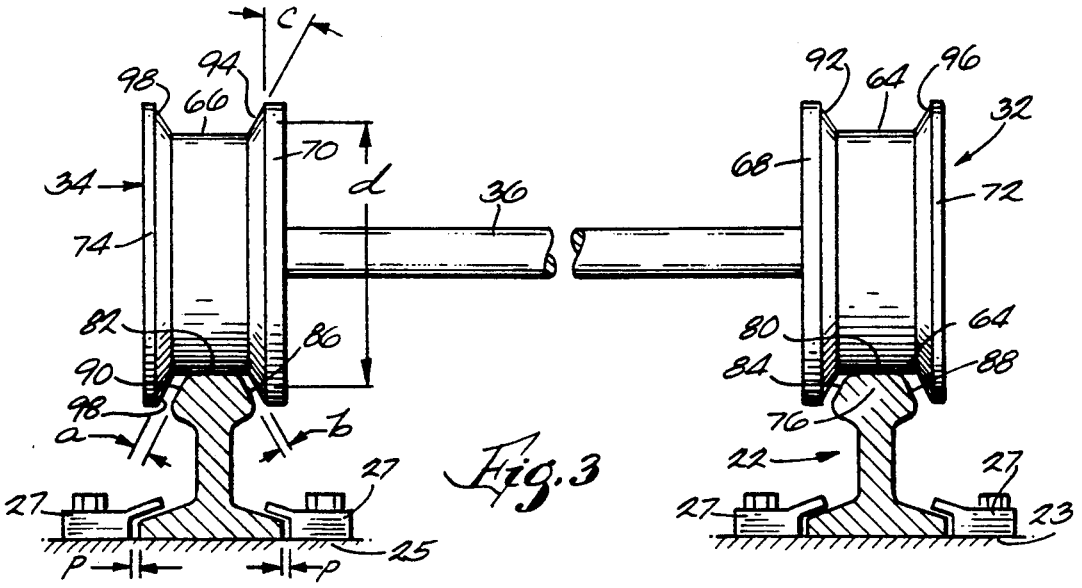
FIG. 3 is a front elevation view showing one pair of drive wheels of the crane of FIGS. 1 and 2 on supporting rails in a parallel, non-skewed traveling position.

Referring generally to FIGS. 1-3, a traveling crane is shown as having a frame 2 including a pair of bridge cross members 4 and 6 each having a width g including respective opposite ends 12, 14 and 16, 18. Trucks 8 and 10 are respectively affixed to the cross members 4 and 6 at the opposite ends 12, 16 and 14, 18 to thereby support the cross members. An operator's cab 20 is suspended from the frame 2. The crane is supported on and driven along a pair of rails 22 and 24 by a cross shaft drive 26 mounted on the bridge member 4 and by a pair of independent drives 28 and 30 mounted on the bridge member 6. The cross shaft drive 26 includes a pair of wheels 32 and 34 respectively rotatably mounted on the trucks 8 and 10 and engaging and rolling on the rails 22 and 24, drive shaft means 36 mechanically interconnecting the wheels 32 and 34 so that they rotate at the same speed, and a drive motor and gear box 38 connected to the shaft 36 for rotating the shaft and wheels 32 and 34. Non-driven idler wheels 33 and 35, having the same configuration respectively as drive wheel 32 and drive wheel 34, are mounted on the truck 10 adjacent the wheels 32 and 34. The independent drive 28 includes a drive wheel 40 rotatably mounted on the truck 8 adjacent the end 16 of the bridge cross member 6 and engaging the rail 22, a motor and gear box 42, and a drive shaft 44 connecting the motor and gear box to the wheel 40. The independent drive 30 includes a drive wheel 46 rotatably mounted on the truck 10 adjacent the end 18 of the bridge cross member 6 and engaging the rail 24, a motor and gear box 48, and a drive shaft 50 connecting the motor and gear box 48 with the wheel 46. The two motor and gear boxes 42 and 48 normally are driven at the same speed, so that the driven wheels 40 and 46 rotate at the same speed. However, if the crane movement along the rails 22 and 24 is in any way impeded, either one or both of the motor and gear boxes 42 and 48 may slow their speed to cause a corresponding decrease in speed of the wheels 40 and 46. Non-driven idler wheels 41 and 47 having the same configuration respectively as drive wheel 40 and drive wheel 46 are respectively mounted on the trucks 8 and 10 adjacent the wheels 40 and 46. The rails 22 and 24 are respectively supported on supports 23 and 25 and are held on the supports by rail retaining clips 27. The clips 27 are mounted on the supports 23 and 25 at lateral float clearance distances p from the flanges 77 and 79 of the respective rails 22 and 24 to permit limited lateral movement of the rails.

A trolley 7 carrying a hoist 9 is supported on and movable along a pair of parallel tracks 52 and 54 supported on the bridge cross members 4 and 6. The hoist 9 includes a rotatable drum 56, rope means 58 extending downward from the drum 56, and a load hook 60 attached to the lower end of the rope means. A load 62 is attached to the hook 60. When the drum 56 rotates, the rope 58 will be paid out from or wound onto the drum to raise and lower the load hook 60 and the load 62 which it carries. The travel of the trolley 7 along the tracks 52 and 54 enables picking up of a load 62 at one location along the width g of the bridge cross members 4 and 6, and moving the load 62 to a different location beneath the width g of the bridge members. The trolley 7 and hoist 9 respectively include motors 17 and 19 for respectively moving the trolley and rotating the drum 56 to raise and lower the load 62. The crane may be operated by well-known controls (not shown) which control the operation of the cross shaft drive 26, the independent drives 28 and 30, the trolley 7 and the hoist 9.

With reference to FIGS. 2 and 3, the cross shaft connected drive wheels 32 and 34 are respectively shown engaging rails 22 and 24 in a position in which the crane is traveling in a position parallel to the rails 22 and 24. The wheels 32 and 34 respectively include cylindrical surfaces 64 and 66 each having a single diameter along its axial width. The wheels 32 and 34 also respectively include inside flanges 68 and 70 and outside flanges 72 and 74. The rails 22 and 24 respectively include heads 76 and 78 having top surfaces 80 and 82 respectively engaged by the wheel cylindrical surfaces 64 and 66, inner side surfaces 84 and 86, and outer side surfaces 88 and 90. The inner side surfaces 84 and 86 face laterally inward toward each other and the outer side surfaces 88 and 90 face laterally outward away from each other. The inside flanges 68 and 70 of the wheels respectively include circumferential inside walls 92 and 94 which respectively face inner side surface 84 of rail head 76 and inner side surface 86 of the rail head 78. The outside flanges 72 and 74 of the wheels 32 and 34 respectively include circumferential inside walls 96 and 98 which, in turn, respectively face outer side surface 88 of rail head 76 and outer side surface 90 of rail head 78. The side surfaces 84 and 86 may each have a taper in a radially outward direction and respectively axially toward the flanges 68 and 70. The clearance distance a between the inside wall 98 of the outside flange 74 and the outer side surface 90 of the rail head 78 is greater than the clearance distance b between the inside wall 94 of the inside flange 70 of wheel 34 and the inner side surface 86 of the rail head 78, as can be seen in FIG. 3. The same spacing relationship exists with respect to the flanges of drive wheel 32 and the rail head 76.

The inside walls 92 and 94 of the flanges 68 and 70 also preferably have a taper at an angle c extending in a radially outward direction and axially away from the rails the walls face, as shown in FIG. 3. The taper angle of the rail head side surfaces 84 and 86, 88 and 90 may, for example, be the same as the taper angle of the flange wall which each head side surface faces. The inside flanges 68 and 70 respectively have a larger diameter than the diameter of the cylindrical surfaces 64 and 66 of the wheels 32 and 34. As can be seen in FIG. 3, the diameters of the inside flanges 68 and 70 designated by the letter d increases along the inside walls 92 and 94, due to the taper of these walls, from a location near the adjoining of the walls 92 and 94 respectively to the cylindrical surfaces 64 and 66, to a maximum value at the outer circumference of the flanges. The diameter d is identified in FIG. 3 at approximately the midpoint between the maximum and minimum diameter values.

Figure 5:
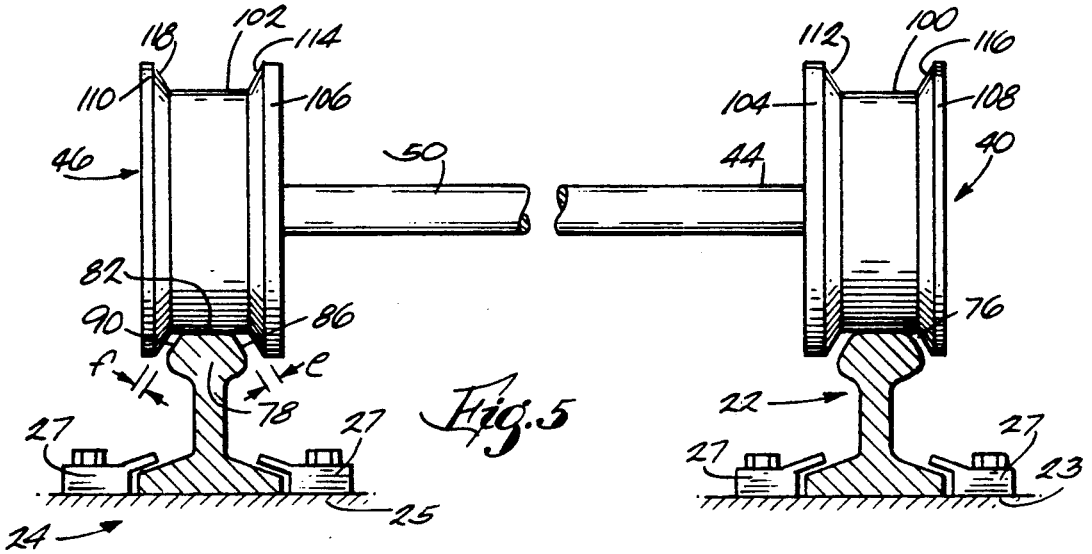
FIG. 5 is a front elevation view showing another pair of drive wheels of the crane of FIGS. 1 and 2 on supporting rails in a parallel, non-skewed traveling position.

With reference to FIGS. 2 and 5, the independently driven drive wheels 40 and 46 are respectively shown engaging rails 22 and 24 in a position in which the crane is traveling in a position parallel to the rails 22 and 24. The wheels 40 and 46 respectively include cylindrical surfaces 100 and 102 each having a single diameter along its axial width. The wheels 40 and 46 also respectively include inside flanges 104 and 106 and outside flanges 108 and 110. The inside flanges 104 and 106 of the wheels respectively include circumferential inside walls 112 and 114 which respectively face inner side surface 84 of rail head 76 and inner side surface 86 of rail head 78. The outside flanges 108 and 110 of the wheels 40 and 46 respectively include circumferential inside walls 116 and 118 which, in turn, respectively face outer side surface 88 of rail head 76 and outer side surface 90 of rail head 78. The clearance distance e between the inside wall 114 of the inside flange 106 and the inner side surface 86 of the rail head 78 is greater than the clearance distance f between the inside wall 118 of the outside flange 110 of wheel 46 and the outer side surface 90 of rail head 78, as can be seen in FIG. 5. The same spacing relationship exists with respect to the flanges of drive wheel 40 and the rail head 76.

The crane has a normally parallel position during its travel in which it moves in a position parallel to the rails 22 and 24 and the wheels 32, 34 and 40, 46 travel on the rails 22 and 24 in the positions shown in FIGS. 2, 3 and 5. While the crane is stationary or moving at a steady rate, the load 62 on the load hook 60 will hang substantially perpendicularly downward from the crane hoist 9 as shown in full lines in FIG. 1. However, when the crane accelerates from a stationary position in the direction of the arrow h illustrated in FIG. 1, the inertia of the load 62 will cause it to lag the motion of the crane and move to a lagging position relative to the position of the crane such as shown in phantom lines and designated by the letter j in FIG. 1. Upon deceleration and stopping of the crane when moving in the direction of the arrow h, the inertia of the load will cause it to continue moving ahead of the crane in the direction of movement of the crane to a position relative to that of the crane such as shown in phantom lines and designated by the letter k in FIG. 1. Most typically, the trolley 7 is positioned at the time of acceleration and deceleration of the crane towards one of the ends of the width of the crane, so that the inertia force of the load upon acceleration or deceleration exerts an unbalanced force along the width g of the bridge cross members 4 and 6 of the frame 2 of the crane. Also, although the rails 22 and 24 are generally parallel, operating forces of the crane may have caused the rails to be displaced from their parallel relationship and deformed at various places along their length. Further, traction of the wheels 32, 24 and 40, 46 is effected by moisture, particles, or other material on the rails or wheels which cause uneven traction and correspondingly varying forces on the bridge cross members. The unbalanced load inertia force on the crane, the lack of parallelism and deformation of the rails, and the materials on the rails causing uneven wheel traction, all contribute to uneven and unbalanced wheel rotating forces on the wheels 2, 34, and 40, 46. Due to the mounting and thereby support of the cross shaft drive 26 on the bridge cross member 4 of the frame 2, these unbalanced forces are transmitted to and received by the cross shaft drive 26. Since the cross shaft drive 26 mechanically connects both of the drive wheels 32 and 34 so that they rotate at the same speed, the cross shaft drive 26 has the effect of applying the unbalanced forces substantially equally and in a relatively even, distributed manner to the two wheels 32 and 34.

In effect, the cross shaft drive 26 masks the uneven characteristic of the forces on the bridge cross members from the wheels 32, 34 and 40, 46. Thus, the tendency of the crane to skew as a result of unbalanced rotation forces on the wheels 32, 34 and 40, 46 is minimized. Further, the effect of applying the unbalanced forces equally to the wheels 32, 34 to minimize skew also maintains independently driven wheels 40, 46 as well as wheels 32, 34 in a non-skewed, high traction position. These benefits cannot be achieved with two cross shaft drives or two pairs of independently driven wheels, previously described. In addition, the high rotating energy storage and stress which results from the use of two cross shaft drives to obtain traction at four drive wheels is avoided by using only one cross shaft drive and one pair of independently driven wheels to obtain the benefits of four driven wheels and cross shaft drive steering.

Figure 4:
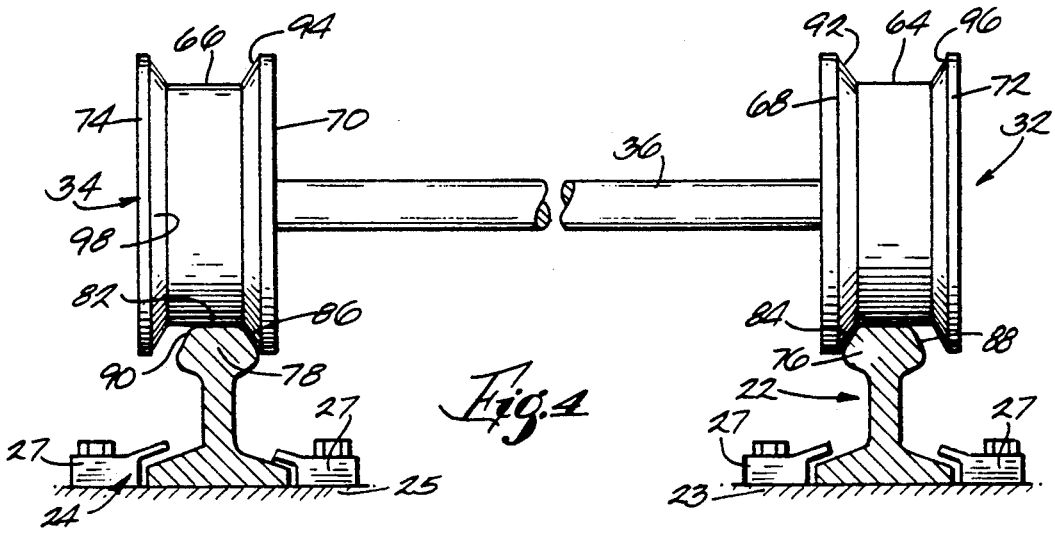
FIG. 4 is a front elevation view of the drive wheels of the crane shown in FIG. 3 in a skewed position in which the lagging skewed wheel is in a position causing correction of the skew.
Figure 6:
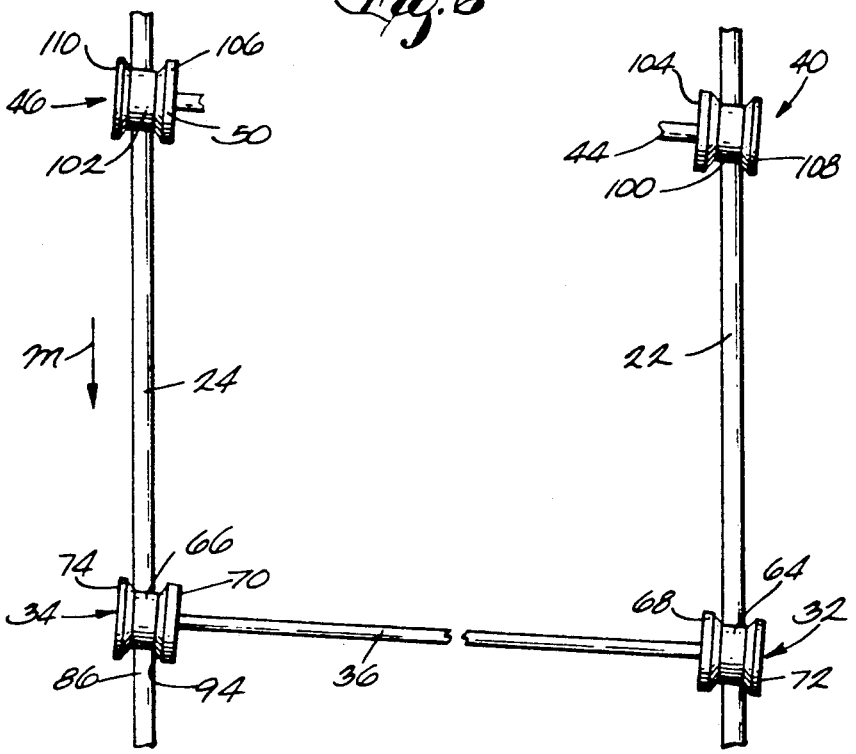
FIG. 6 is a schematic plan view showing the driven wheels of the crane in a skewed position while the crane is traveling along a rail supporting the crane.

With reference to FIG. 6, if the crane is traveling in the direction of the arrow m so that the cross shaft driven wheels 32, 34 lead the independently driven wheels 40, 46 and the crane becomes skewed as shown in FIG. 6, the cross shaft drive 26 steers the wheels 32 and 34 to correct the skew. The correction of skewing by steering the wheels 32 and 34 is accomplished in accord with the invention in the same way when the crane is traveling in the direction of the arrow m whether the lagging skewed wheel is wheel 32 or wheel 34. Consequently, only the correction of the skewed condition shown in FIG. 6 in which the wheel 34 is the lagging wheel is described in detail. Also, it should be noted that the extent of the skew is exaggerated in FIG. 6 for illustrative purposes. When the crane is skewed and traveling generally in the direction of the arrow m, the inside wall 94 of the inside flange 70 of the drive wheel 34 moves toward and engages the inner side surface 86 of the rail head 78. This motion of the inside wall 94 of the flange 78 causes the flange 70 to rotate or roll onto the side surface 86 of the rail head 78 at the larger diameter of the flange 70, as illustrated in FIG. 4, rather than rotate on the rail head surface 82 at the smaller diameter of the cylindrical surface 66 as shown in FIG. 3. The rotation of the flange 70 on the rail side surface 86 at a larger diameter area will, in turn, cause the wheel 34 to travel at a higher linear speed than the linear speed of the wheel 32. The wheel 32 continues to travel along its cylindrical surface 64 on the surface 80 of the head 76 of rail 22. Thus, since the wheels 32 and 34 are interconnected so that they both rotate at the same speed, the higher linear speed of the lagging wheel 34 will cause it to catch up with the leading wheel 32 and correct the skew. The crane is thereby returned to its parallel position on the rails 22 and 24. As previously described, the clearance distance b between the flange wall 92 and the rail head side surface 84 and between the flange wall 94 and the rail head side surface 86 are smaller than the clearance distance a between the flange walls 96 and 98 and their respective facing rail head side surfaces 88 and 90. Therefore, only the flange walls 92 and 94 engage the rail head side surfaces which they face when the crane is skewed. As a consequence, the outer flanges 72 and 74 will not engage the rail head and thereby exacerbate the skew or prevent the skew corrective engagement of the flange walls 68 and 70 respectively with the rail head side surfaces 84 and 86.

The steering of the wheels 32 and 34 by the cross shaft drive 26 to correct the skew when the crane is traveling in the direction of arrow m also steers independently driven wheels 40 and 46. Thus, the cooperation of the cross shaft drive 26 which distributes uneven forces on the crane between the wheels 32 and 34, the steering by the cross shaft drive 26 of all four wheels 32, 34, 40 and 46, and increased traction at all four driven wheels due to the correction of skew at the cross shaft driven wheels provides a crane which has a minimum tendency to skew, and has increased capability of correcting the skew if it does occur.

Figure 7:
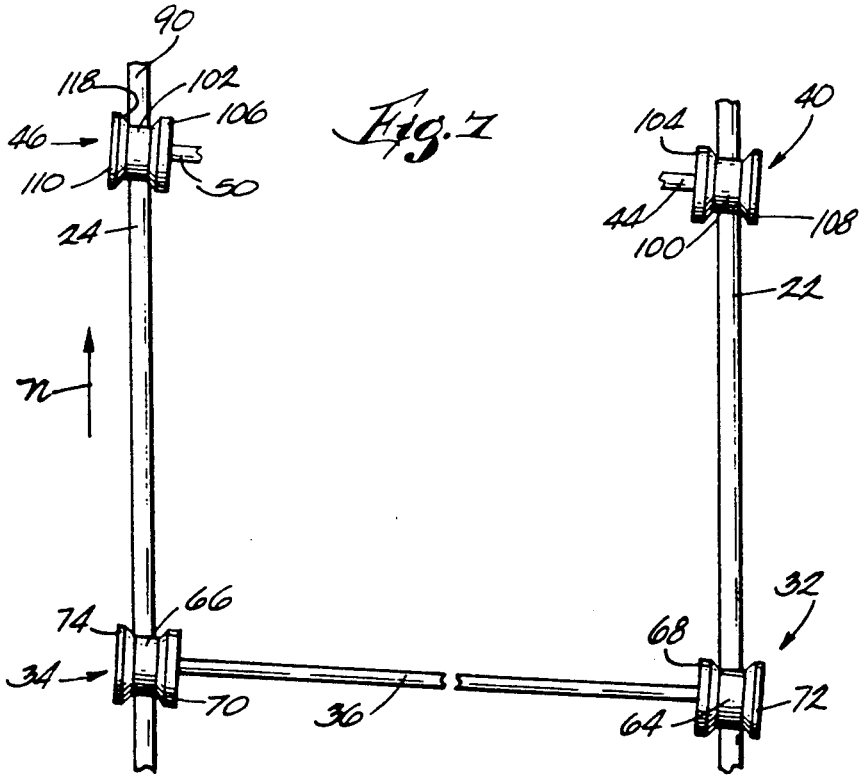
FIG. 7 is a schematic plan view similar to that of FIG. 6 showing the wheels of the crane in a skewed position while the crane is traveling along the supporting rails in a direction opposite to the direction of travel of the crane shown in FIG. 6.

With reference to FIG. 7, in which the crane is shown in an exaggerated skewed position for illustrative purposes, when the crane is skewed and is traveling in the direction of the arrow n, the inside wall 118 of the outside flange 110 of the independently driven leading wheel 46 will engage and rotate against the outer side surface 90 of the rail head 78 and the inside flange 106 of the wheel 46 will not engage the rail head 78 due to the clearance e being larger than the clearance f. Because the wheel 46 is independently driven, its rotational and linear speed will slow down, relative to the speed of wheel 40, due to the friction contact of the wall 118 with rail head surface 90 of the rail head 76 to provide a skew correcting effect. Further, when the crane is skewed as shown in FIG. 7, the flange 70 of the wheel 34 will bear against the rail side 86 to prevent the flange 108 of wheel 40 from bearing against the rail side 88 and also slow the wheel 40 down and prevent correction of skew due to slowing of both wheels 46 and 40. If the crane is traveling in the direction of the arrow n, but is skewed in a direction opposite to that shown in Fig. 7, the leading wheel will be wheel 40 and skew correction will take place in the same manner as described with respect to wheel 46. Thus it is also the case when the crane is traveling in the direction of the arrow n, that the increased and more consistent traction resulting from minimizing skew and driving four wheels, tends to enhance skew minimization and assist with its correction.

Figure 8:
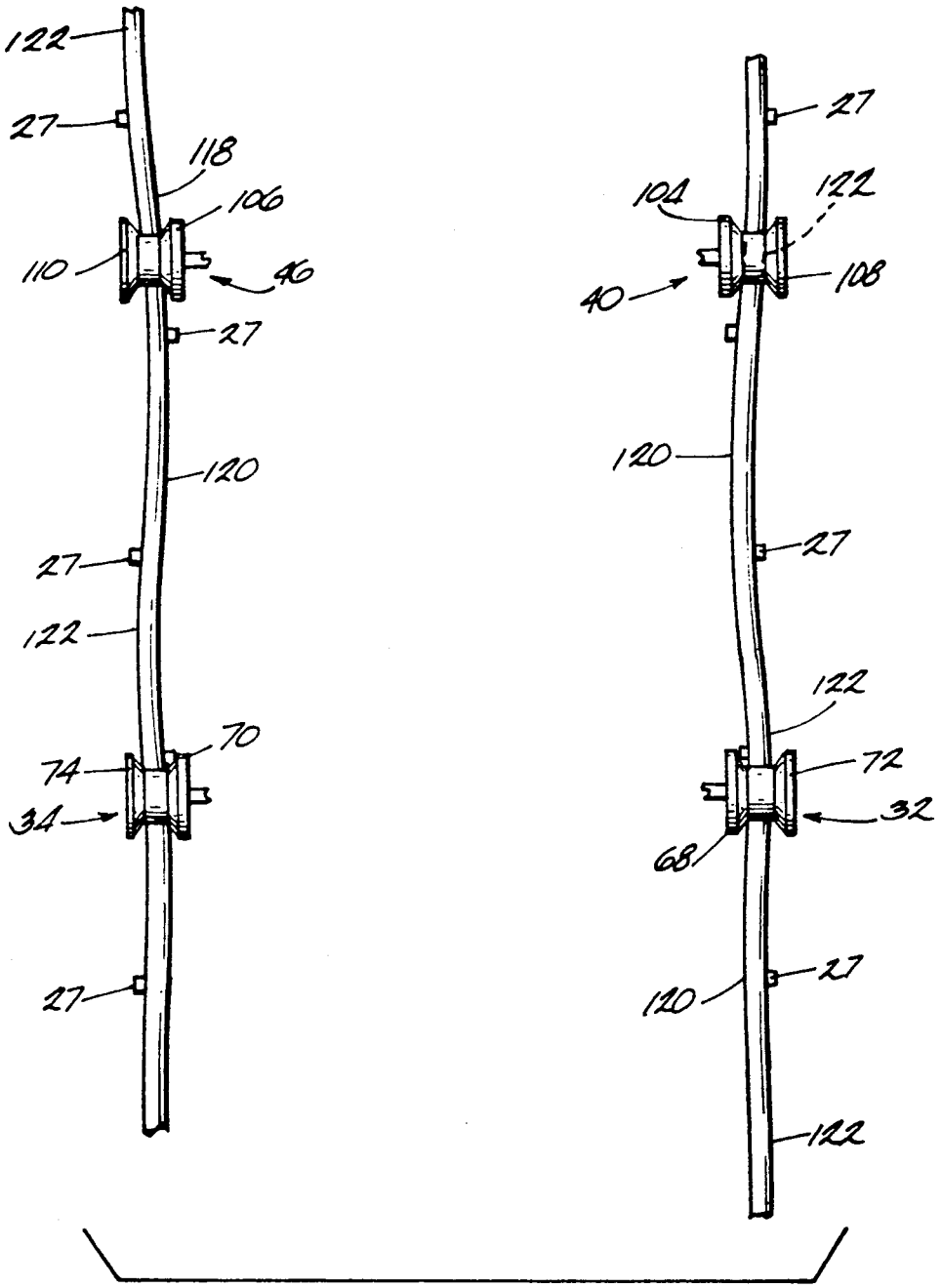
FIG. 8 is a schematic plan view illustrating the deviation of the supporting rails as a result of skew and other forces.

The flange to rail clearances of the cross shaft driven wheels 32, 34 and the independently driven wheels 40, 46 also result in the wheels acting together to straighten the rails 22 and 24. Specifically, with reference to FIG. 8 and considering rail 24, when the rail is deformed or deviates in lateral directions, the inside flange 70 of the wheel 34, due to the relatively small clearance b, pushes against the rail deviations 120 in a direction laterally outward away from the rail 22. The outside flange 110 of the wheel 46, due to the relatively small clearance f, pushes against the rail deviations 122 in a direction laterally inward toward the rail 22. It may be noted that the flanges 70 and 110 will bear and push against only that portion of the rail deviations 120 and 122 which, in their lateral extension distance, exceed the small clearance distances b or f. The flanges 68 and 108 of respective wheels 32 and 40 operate in a similar manner to push against the rail deviations 120 and 122 to straighten the rail 22. If the rails are affixed to their supports 23 and 25 by rail clips 27 which permit limited lateral movement of the rails 22 and 24, the movement due to the pushing force of the wheel flanges to straighten the rails will be facilitated.

It will be understood that the foregoing description of the present invention is for purposes of illustration, and that the invention is susceptible to a number of modifications or changes, none of which entail any departure from the spirit and scope of the present invention as defined in the hereto appended claims. For example, a pair of relatively large, low slip speed induction motors can be substituted for the cross shaft drive to separately drive the wheels 32 and 34 such that the wheels rotate at substantially the same speed, the speed difference being only in the slip of the two motors relative to each other.

What is claimed is:

1. In a traveling bridge crane having a bridge including opposite ends and a width spanning two parallel spaced apart rails, a first pair of wheels comprising first and second wheels respectively mounted at the opposite ends of the bridge and each engaging a different one of the rails, and a second pair of wheels spaced form the first pair of wheels and comprising third and fourth wheels also mounted at the opposite ends of the bridge and each engaging a different one of the rails, the crane and the first and second pair of wheels traveling at a linear speed along and in a position generally parallel to the rails and being subject to unbalanced wheel rotating forces along the width of its bridge causing skew of the crane, the bridge crane comprising:

first drive means connected to the first wheel of the first pair of wheels for rotating the first wheel independently of the second wheel;

second drive means connected to the second wheel of the first pair of wheels for rotating the second wheel independently of the first wheel; and third drive means mounted on the bridge and connected to the third and fourth wheels of the second pair of wheels for rotating the third and fourth wheels at substantially the same speed, the third drive means receiving the unbalanced wheel rotating forces along the width of the bridge and applying said forces substantially equally to the third and fourth wheels and minimizing application of the unbalanced wheel rotating forces to the first and second pair of wheels causing movement of both the first and second pair of wheels causing skew of the crane is minimized.

2. The bridge crane according to claim 1 wherein the third drive means includes means interconnecting the third and fourth wheels for steering the third and fourth wheels to correct skew of the crane.

3. The bridge crane according to claim 1 or 2 wherein each of the first and second wheels has inner and outer radially extending flanges facing and spaced apart from the rail with which their associated wheel is engaged, the inner and outer flanges of each of the first and second wheels each having a spacing distance from a rail, the spacing distance of the outer flange being less than that of the inner flange.

4. The bridge crane according to claim 1 or 2 wherein:

each of the third and fourth wheels has a cylindrical rail engaging member and inner and outer radially extending flanges at opposite ends of the cylindrical member facing and spaced apart from the rail with which their associated cylindrical member is engaged; and each of the inner and outer flanges of each of the third and fourth wheels has a larger diameter than its associated cylindrical member and a spacing distance from a rail, the spacing distance of the inner flange being less than that of the outer flange such that, upon skewing of the crane so that one of the third and fourth wheels lags the other wheel and the inner flange of the lagging wheel rolls toward and onto the rail which the lagging wheel engages and the outer flange of the lagging wheel does not interfere with such rolling motion of the inner flange, the linear speed of the lagging wheel is increased due to its rotation along the large diameter of the inner flange to move the lagging wheel forward and eliminate the skew of the crane.

5. The bridge crane according to claim 4 wherein each of the first and second wheels has inner and outer radially extending flanges facing and spaced apart from the rail with which their associated wheel is engaged, the inner and outer flanges of each of the first and second wheels each having a spacing distance from a rail, the spacing distance of the outer flange being less than that of the inner flange.

6. The bridge crane according to claim 5 wherein the spacing distance of the outer flange of the first wheel is substantially equal to the spacing distance of the inner flange of the third wheel, the first and third wheels each engaging the same one of the rails, and the spacing distance of the outer flange of the second wheel is substantially equal to the spacing distance of the inner flange of the fourth wheel, the second and fourth wheels each engaging the other one of the rails.

7. In a traveling bridge crane having a bridge including opposite ends and a width spanning two parallel spaced apart rails, a first pair of wheels comprising first and second wheels respectively mounted at the opposite ends of the bridge and each engaging a different one of the rails, and a second pair of wheels comprising third and fourth wheels also mounted at the opposite ends of the bridge and each engaging a different one of the rails, whereby the crane travels along and in a position generally parallel to the rails, but is subject to skewing due to various forces acting on the crane and its wheels such that one of the first and second wheels lags the other and one of the third and fourth wheels lags the other, a drive system comprising:

first drive means connected to the first wheel of the first pair of wheels for rotating the first wheel independently of the second wheel and applying traction force at the first wheel;

second drive means connected to the second wheel of the first pair of wheels for rotating the second wheel independently of the first wheel and applying traction force at the second wheel; and third drive means connected to the third and fourth wheels for applying traction force to the third and fourth wheels to rotate them at substantially the same speed and for steering the third and fourth wheels to correct the skew and maintain the traction force at each of the first, second, third and fourth wheels.

8. The drive system according to claim 7 wherein the third drive means includes means interconnecting the third and fourth wheels.

9. The drive system according to claim 7 or 8 wherein each of the third and fourth wheels has a cylindrical portion engaging a rail and having a diameter and inner and outer radially extending flanges facing the rail which the cylindrical portions of the respective third and fourth wheels engage, each of the inner and outer flanges connecting to and having a larger diameter than the cylindrical portion, the inner and outer flanges of each of the third and fourth wheels each having a spacing distance from the rail which they face, the spacing distance of each inner flange of the third and fourth wheels being less than that of each outer flange of the same third and fourth wheels such that the inner flange of the lagging skewed wheel of the third and fourth wheels rotates onto the rail which the inner flange faces at the large diameter of the inner flange whereby the linear speed of the lagging wheel is increased and the skew of the first, second, third and fourth wheels is corrected.

10. The drive system according to claim 7 or 8 wherein:

the crane has a first direction of travel along the rails in which the first and second wheels lead the third and fourth wheels and a second opposite direction of travel in which the third and fourth wheels lead the first and second wheels; and the third drive means steers the third and fourth wheels to correct said skew and maintain said traction when the crane is traveling in the second direction.

11. The drive system according to claim 10 wherein each of the first and second wheels has inner and outer radially extending flanges facing and spaced apart from the rail with which their associated wheel is engaged, the inner and outer flanges of each wheel each having a spacing distance from a rail which the flanges face, the spacing distance of the outer flange being less than that of the inner flange such that the outer flange of the leading one of the skewed first and second wheels, when the crane is traveling in the first direction, rotates in engagement with the rail from which said outer flange has said lesser spacing distance whereby the linear speed of the leading one of the skewed first and second wheels slows down due to friction resulting from such engagement and the skew of the first, second, third and fourth wheels is corrected.

12. A method of driving a traveling crane along a pair of parallel spaced apart rails, the crane including a bridge having a width spanning the rails and first and second ends each adjacent a different one of the rails, first and second wheels mounted opposite each other respectively at the first and second ends of the bridge and engaging a different one of the rails, third and fourth wheels mounted opposite each other respectively at the first and second ends of the bridge and engaging a different one of the rails, the crane being subject to unbalanced wheel rotating forces along the width of the bridge, comprising the steps of:

rotatably driving the first wheel independently of the second, third and fourth wheels to provide traction for the crane;

rotatably driving the second wheel independently of the first, third and fourth wheels to provide traction for the crane; and simultaneously with the driving of the first and second wheels, rotatably driving the third and fourth wheels at substantially the same speed to provide traction for the crane while applying the unbalanced wheel rotating forces substantially equally tot eh third and fourth wheels to minimize the unbalanced force on the first and second independently driven wheels and steering the third and fourth wheels to correct skew of the crane and enable the first, second, third and fourth wheels to maintain effective driving traction.

13. The method according to claim 12 wherein the crane travels either in a first direction along the rails in which the first and second wheels lead the third and fourth wheels or in a second opposite direction along the rails in which the third and fourth wheels lead the first and second wheels, and wherein the step of steering the third and fourth wheels is carried out only when the crane is traveling in the second direction and the third and fourth wheels lead the first and second wheels.

* * * * *